US012397983B2

(12) United States Patent
Kominami et al.

(10) Patent No.: US 12,397,983 B2
(45) Date of Patent: Aug. 26, 2025

(54) CLOSURE DEVICE AND SOFT PACKAGING CONTAINER

(71) Applicant: Toyo Seikan Co., Ltd., Tokyo (JP)

(72) Inventors: Atsushi Kominami, Kanagawa (JP); Souji Araki, Kanagawa (JP); Hiroki Tanaka, Kanagawa (JP)

(73) Assignee: Toyo Seikan Co., Ltd., Tokyo (JP)

( * ) Notice: Subject to any disclaimer, the term of this patent is extended or adjusted under 35 U.S.C. 154(b) by 125 days.

(21) Appl. No.: 17/800,894

(22) PCT Filed: Feb. 16, 2021

(86) PCT No.: PCT/JP2021/005777

§ 371 (c)(1),
(2) Date: Aug. 18, 2022

(87) PCT Pub. No.: WO2021/172113

PCT Pub. Date: Sep. 2, 2021

(65) Prior Publication Data

US 2023/0086124 A1 Mar. 23, 2023

(30) Foreign Application Priority Data

Feb. 28, 2020 (JP) ..... 2020-034292

(51) Int. Cl.
*B65D 75/58* (2006.01)
*B65B 51/04* (2006.01)
(Continued)

(52) U.S. Cl.
CPC ..... *B65D 83/771* (2025.01); *B65B 51/04* (2013.01); *B65B 51/10* (2013.01); *B65B 57/00* (2013.01);
(Continued)

(58) Field of Classification Search
CPC ..... B65D 83/0055; B65D 75/5811; B65D 31/16; B65D 75/566; B65B 51/04; B65B 51/10; B65B 57/00
See application file for complete search history.

(56) References Cited

U.S. PATENT DOCUMENTS 5,213,236 A 5/1993 Brown
6,269,837 B1 * 8/2001 Arent ..... B67D 7/0205 251/149.6
(Continued)

FOREIGN PATENT DOCUMENTS

CN 104670706 A 6/2015
CN 105882973 A 8/2016
(Continued)

OTHER PUBLICATIONS

ISA/237) Written Opinion of the International Search Authority for International Patent Application No. PCT/JP2021/005777, issued/mailed by the Japan Patent Office on Apr. 13, 2021.
(Continued)

*Primary Examiner* — Frederick C Nicolas

(57) ABSTRACT

Provided is a closure device for closing a soft packaging container, the closure device including a holding section configured to hold a soft packaging container, a dispense section configured to dispense contents of the soft packaging container, a closure section configured to close the soft packaging container, and a control section configured to control timing for closing the soft packaging container by the closure section. The control section may include an acquisition section configured to acquire time information related to timing for closing the soft packaging container. Provided is a soft packaging container for accommodating contents, the soft packaging container including a main
(Continued)

region for accommodating the contents, and an extension region provided by being extended from the main region.

16 Claims, 20 Drawing Sheets

(51) Int. Cl.

| | |
|---|---|
| ***B65B 51/10*** | (2006.01) |
| ***B65B 57/00*** | (2006.01) |
| ***B65D 30/10*** | (2006.01) |
| ***B65D 75/56*** | (2006.01) |
| ***B65D 83/00*** | (2006.01) |

(52) U.S. Cl.
CPC ..... *B65D 31/16* (2013.01); *B65D 75/566* (2013.01); *B65D 75/5811* (2013.01)

(56) References Cited

U.S. PATENT DOCUMENTS

| | | | | |
|---|---|---|---|---|
| 6,390,329 | B1 * | 5/2002 | Maddox | A47K 5/1208 222/25 |
| 8,240,508 | B2 * | 8/2012 | Wegelin | G05B 15/02 222/105 |
| 8,550,378 | B2 * | 10/2013 | Mazooji | B05B 3/02 222/88 |
| 9,504,360 | B2 * | 11/2016 | Van Diepen | A47K 5/1217 |
| 9,884,336 | B2 * | 2/2018 | Hoefte | B05B 11/0054 |
| 10,500,699 | B2 | 12/2019 | Chang | |
| 2005/0284888 | A1 | 12/2005 | Rhodenbaugh | |
| 2009/0212072 | A1 * | 8/2009 | Fenton | B05B 11/0044 222/173 |
| 2009/0314783 | A1 | 12/2009 | Losinski | |
| 2011/0114669 | A1 * | 5/2011 | Yang | A47K 5/16 222/639 |
| 2014/0103066 | A1 | 4/2014 | Geert Norbert | |
| 2016/0101430 | A1 | 4/2016 | Hoefte | |
| 2017/0043870 | A1 | 2/2017 | Wu | |
| 2019/0210726 | A1 | 7/2019 | Wu | |

FOREIGN PATENT DOCUMENTS

| | | | |
|---|---|---|---|
| CN | 107826251 | A | 3/2018 |
| CN | 110816842 | A | 2/2020 |
| EP | 2332453 | A1 | 6/2011 |
| JP | H1084837 | A | 4/1998 |
| JP | 2010001007 | A | 1/2010 |
| JP | 2013224167 | A | 10/2013 |
| JP | 2017531492 | A | 10/2017 |
| JP | 2018516197 | A | 6/2018 |
| JP | 2019172355 | A | 10/2019 |
| KR | 20150003981 | A | 1/2015 |
| TW | 208691 | B | 7/1993 |
| TW | 200415081 | A | 8/2004 |

OTHER PUBLICATIONS

ISA/237) Written Opinion of the International Search Authority for International Patent Application No. PCT/JP2021/005773, issued/mailed by the Japan Patent Office on May 11, 2021.

Office Action issued for related Japanese Application No. 2020-034282, transmitted from the Japanese Patent Office on Sep. 26, 2023 (drafted on Sep. 13, 2023).

Office Action issued for related Chinese Application 202180007368.9, issued by The State Intellectual Property Office of People's Republic of China on Aug. 24, 2024.

Office Action issued for counterpart Taiwanese Application 110106843, transmitted from the Taiwan Intellectual Property Office on Sep. 30, 2024 (issued on Sep. 25, 2024).

Office Action issued for related U.S. Appl. No. 17/801,267, issued by the US Patent and Trademark Office on Mar. 18, 2025.

Office Action issued for counterpart Chinese Application 202180015853.0, issued by The State Intellectual Property Office of People's Republic of China on Jun. 4, 2025.

* cited by examiner

CLOSURE DEVICE AND SOFT PACKAGING CONTAINER

CROSS-REFERENCE TO RELATED APPLICATIONS

This application is a National Stage Entry of International Application NO. PCT/JP2021/005777 filed in WO on Feb. 16, 2021, which claims priority to Japanese Patent Application NO. 2020-034292 filed in JP on Feb. 28, 2020, the contents of each of which are hereby incorporated by reference in their entirety.

BACKGROUND

1. Technical Field

The present invention relates to a closure device and a soft packaging container.

2. Related Art

Up to now, a pouch for accommodating contents has been known (for example, see Patent Document 1).

Patent Document 1: Japanese Patent Application Publication No. 2019-172355

Technical Problem

Up to now, control on timing for opening and closing a pouch has been difficult in some cases.

GENERAL DISCLOSURE

According to a first aspect of the present invention, there is provided a closure device for closing a soft packaging container, the closure device including: a holding section configured to hold a soft packaging container; a dispense section configured to dispense contents of the soft packaging container; a closure section configured to close the soft packaging container; and a control section configured to control timing for closing the soft packaging container by the closure section.

The control section may include an acquisition section configured to acquire time information related to timing for closing the soft packaging container. The control section may close the soft packaging container according to the time information acquired by the acquisition section.

The control section may include a sensing section configured to sense a content amount of the soft packaging container.

The closure section may close the soft packaging container when a content amount of the soft packaging container becomes lower than a predetermined amount.

The closure section may have a thermal welding mechanism configured to close the soft packaging container by thermal welding.

The closure section may have a closure member applying mechanism configured to apply a closure member to the soft packaging container to be closed.

The closure section may have a folding mechanism configured to fold the soft packaging container.

The closure section may have a restraint section applying mechanism configured to restraint a folded section applied by the folding mechanism.

The closure section may have a pinching mechanism configured to pinch the soft packaging container to be closed.

The closure device may have a failure avoiding section configured to avoid failure upon closure by moving the contents in a closure region of the soft packaging container.

The failure avoiding section may have a squeezing mechanism configured to squeeze the soft packaging container. The squeezing mechanism may squeeze contents of the soft packaging container to move the contents in the closure region.

The failure avoiding section may have an orientation change section configured to change an orientation of the soft packaging container. The orientation change section may move the contents from the closure region by a change in an orientation of the soft packaging container.

The closure device may have a cutting section configured to unseal the closed soft packaging container by cutting.

The closure device may have a closure detection section configured to detect closure of the soft packaging container.

The closure device may have an accommodation section configured to accommodate the soft packaging container. The accommodation section may be opened after closure of the soft packaging container.

The dispense section may include an ejection device configured to eject the contents of the soft packaging container.

According to a second aspect of the present invention, there is provided a soft packaging container for accommodating contents, the soft packaging container including: a main region for accommodating the contents; and an extension region provided by being extended from the main region.

The extension region may be provided along an edge of the soft packaging container. The main region and the extension region may form a C-shaped structure.

The extension region may have a length that is 50% or more of a width of the soft packaging container.

The summary clause does not necessarily describe all necessary features of the embodiments of the present invention. The present invention may be a sub-combination of the features described above.

DESCRIPTION OF EXEMPLARY EMBODIMENTS

Hereinafter, the present invention will be described through embodiments of the invention, but the following embodiments do not limit the invention according to the claims. In addition, not all combinations of the features described in the embodiments necessarily have to be essential to solving means of the invention.

Figure 1A:
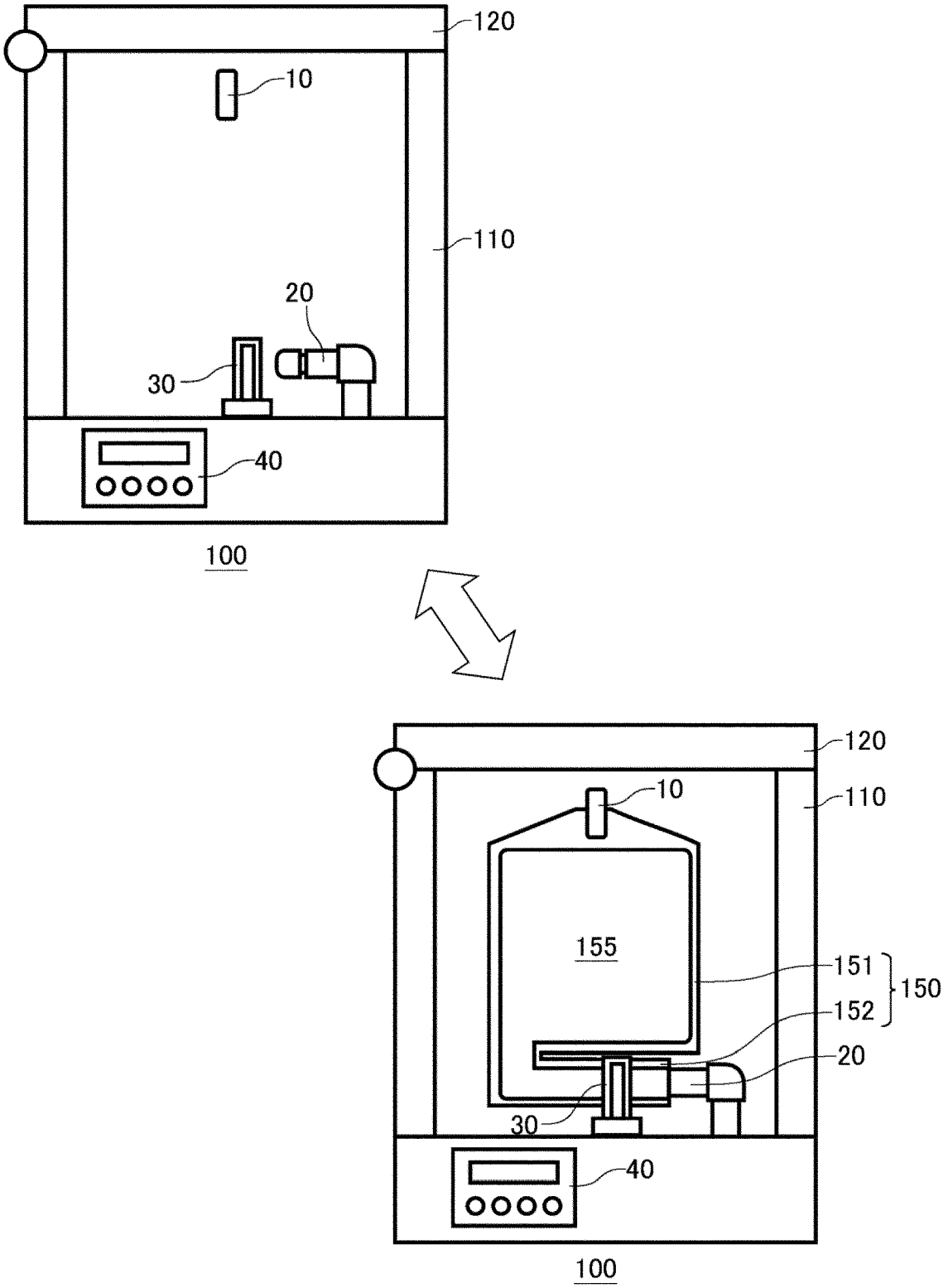
FIG. 1A illustrates an example of a configuration of a closure device 100.

FIG. 1A illustrates an example of a configuration of a closure device 100. The closure device 100 includes an accommodation section 110 and a lid section 120. In addition, the closure device 100 includes a holding section 10, a dispense section 20, a closure section 30, and a control section 40. The present example illustrates states before and after the closure device 100 accommodates a soft packaging container 150.

The closure device 100 accommodates the soft packaging container 150 and dispenses contents 155 from the unsealed soft packaging container 150. The closure device 100 closes the unsealed soft packaging container 150. The closure device 100 accommodates the soft packaging container 150 in the accommodation section 110. The lid section 120 is a lid of the accommodation section 110 accommodating the soft packaging container 150. In the closure device 100, the soft packaging container 150 can be taken out and put in by opening and closing the lid section 120.

The holding section 10 is configured to hold the soft packaging container 150. For example, the holding section 10 has a hook shape to be hooked at an opening provided in the soft packaging container 150. The holding section 10 may hold the soft packaging container 150 by nipping. The holding section 10 of the present example holds only an upper end of the soft packaging container 150 but may hold an entirety of the soft packaging container 150.

The dispense section 20 is configured to dispense the contents 155 from the soft packaging container 150. The dispense section 20 is inserted into the opening of the soft packaging container 150. For example, the dispense section 20 ejects the contents 155 from an external nozzle of the closure device 100.

The closure section 30 is configured to close the unsealed soft packaging container 150. Closure refers to closing of an outlet in a state where the contents 155 cannot be dispensed from the soft packaging container 150. That is, the closure section 30 may change the soft packaging container 150 from an unsealed state into a sealed state, or may change the state into a state where the contents 155 cannot be dispensed by folding the opening of the soft packaging container 150 or the like.

The control section 40 is configured to control timing for closing the soft packaging container 150 by the closure section 30. For example, the control section 40 controls closure timing of the soft packaging container 150 according to a content amount, expiry date, or the like of the contents 155. In an example, when an amount of the contents 155 of the soft packaging container 150 becomes lower than a predetermined amount, the control section 40 causes the closure section 30 to close the soft packaging container 150.

The soft packaging container 150 accommodates the contents 155. The soft packaging container 150 includes a main region 151 and an extension region 152. A capacity of the main region 151 is larger than a capacity of the extension region 152. The extension region 152 is provided by being extended from the main region 151. The extension region 152 is connected to the dispense section 20. An opening for dispensing the contents 155 is provided in the extension region 152, and is closed by the closure section 30. The soft packaging container 150 will be described below.

Figure 1B:
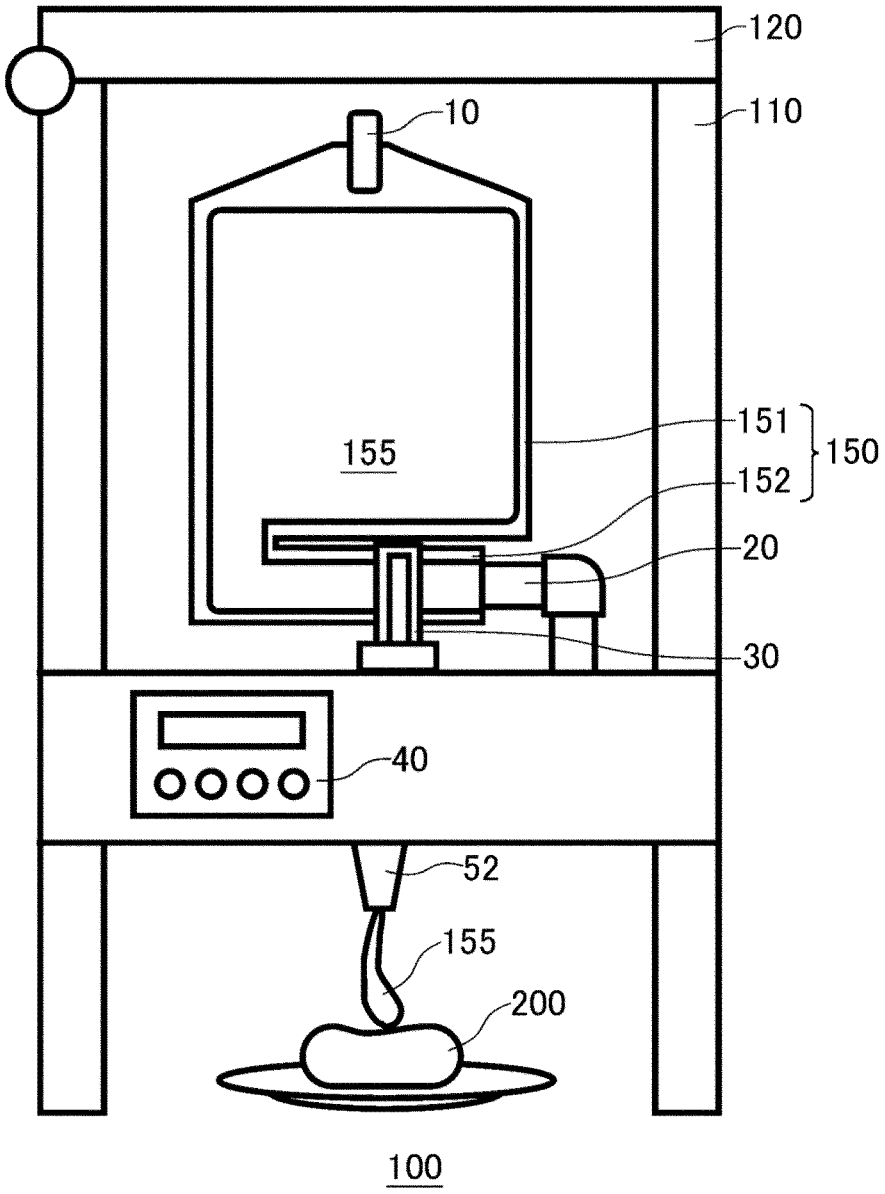
FIG. 1B illustrates an example of an embodiment of the closure device 100.

FIG. 1B illustrates an example of an embodiment of the closure device 100. The closure device 100 of the present example applies Japanese horseradish corresponding to the contents 155 to vinegared rice corresponding to an object 200. The closure device 100 of the present example includes a nozzle 52.

For example, the closure section 30 closes the soft packaging container 150 after the end of business hours. In addition, the closure section 30 closes the soft packaging container 150 after the use of the contents 155. In this manner, contamination of the closure device 100 or the like due to leakage of the contents 155 is prevented upon replacement of the soft packaging container 150.

The nozzle 52 is configured to extract the contents 155 towards the object 200. The nozzle 52 may have a shape according to a use. The nozzle 52 of the present example has a shape appropriate to extract Japanese horseradish corresponding to the contents 155 to vinegared rice corresponding to the object 200.

Figure 2:
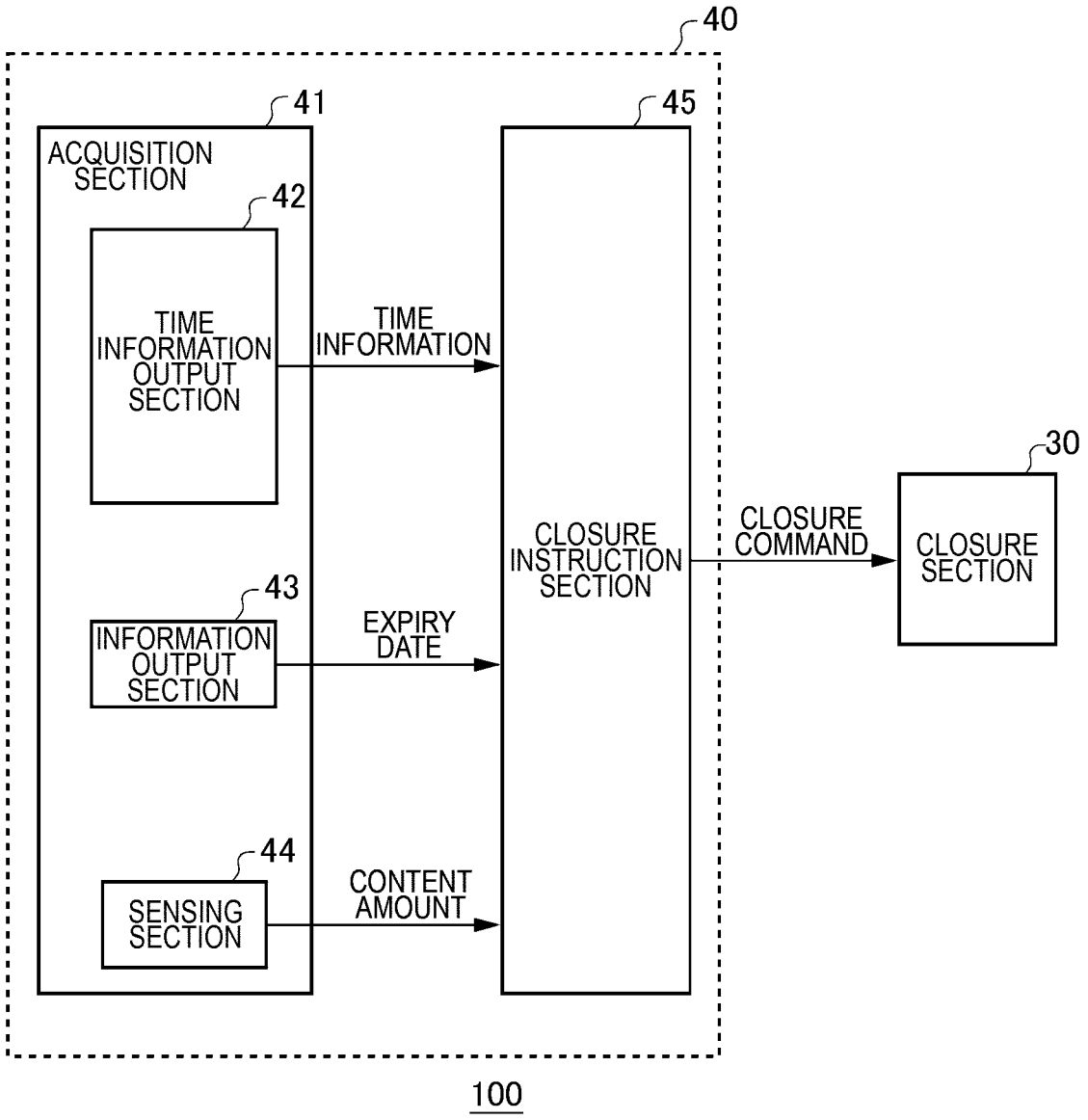
FIG. 2 illustrates an outline of the configuration of the closure device 100.

FIG. 2 illustrates an outline of the configuration of the closure device 100. The control section 40 includes an acquisition section 41 and a closure instruction section 45.

The acquisition section 41 is configured to acquire information required to decide the closure timing. The acquisition section 41 has a time information output section 42, an information output section 43, and a sensing section 44.

The time information output section 42 is configured to output time information related to timing for closing the soft packaging container 150. For example, the time information output section 42 has a timer, and outputs elapsed time since the soft packaging container 150 is unsealed to the closure instruction section 45. In addition, the time information output section 42 may have clock time acquisition means such as a clock, and output a current time to the closure instruction section 45.

The information output section 43 is configured to acquire information required to decide the closure timing of the soft packaging container 150. For example, the information output section 43 outputs an expiry date of the soft packaging container 150 to the closure instruction section 45. The information output section 43 may directly acquire the expiry date from the soft packaging container 150 accommodated in the closure device 100 or may acquire information input by a user or the like.

The sensing section 44 is configured to sense a content amount of the soft packaging container 150. The sensing section 44 may sense a total capacity of the soft packaging container 150 before use or may sense a remaining amount of the contents 155. For example, the sensing section 44 senses the content amount of the soft packaging container 150 based on a weight of the soft packaging container 150.

The closure instruction section 45 is configured to decide whether the soft packaging container 150 is to be closed according to input information. For example, the closure instruction section 45 closes the soft packaging container 150 according to at least one of the time information, the expiry date, or the content amount acquired by the acquisition section 41. When the soft packaging container 150 is to be closed, the closure instruction section 45 inputs a closure command to the closure section 30.

Figure 3:
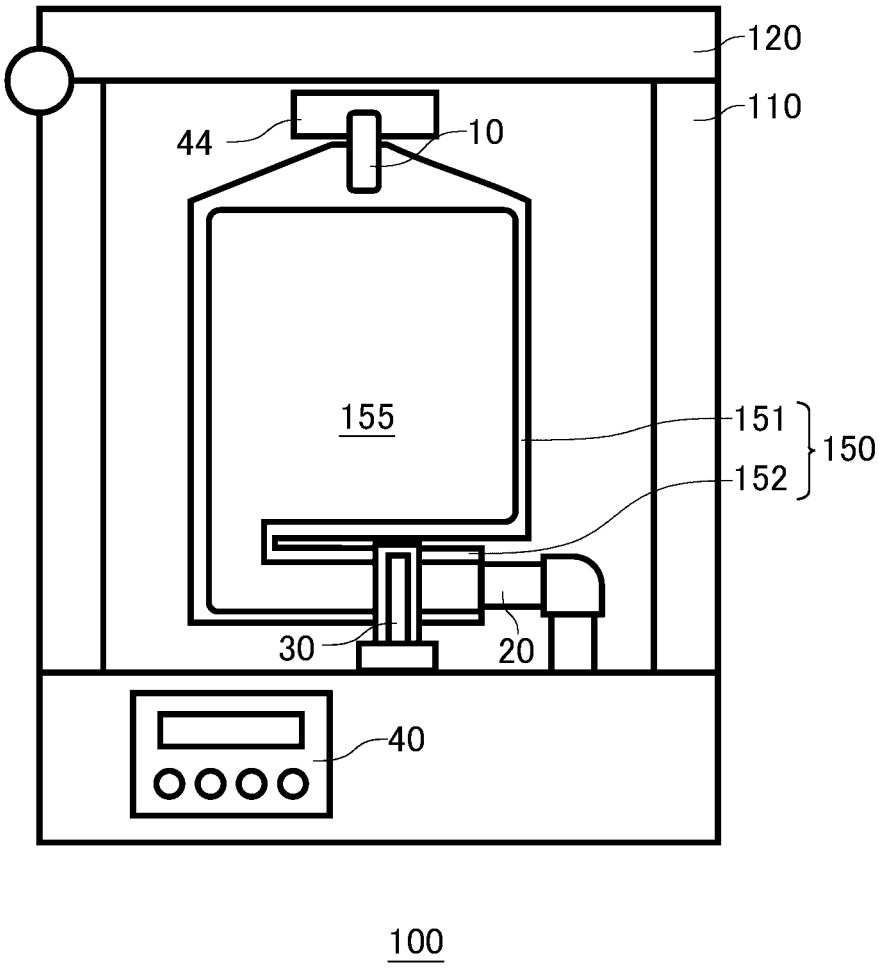
FIG. 3 illustrates an example of the configuration of the closure device 100 including a sensing section 44.

FIG. 3 illustrates an example of the configuration of the closure device 100 including the sensing section 44. The closure device 100 of the present example is different from the closure device 100 of FIG. 1A in that the sensing section 44 is included. In the present example, an aspect different from the case of FIG. 1A will be described in particular.

The sensing section 44 senses a remaining amount of the contents 155 of the soft packaging container 150. The sensing section 44 of the present example is a weight sensor configured to sense a remaining amount of the contents 155 by measuring a weight of the soft packaging container 150. The sensing section 44 is coupled to the holding section 10 and measures the weight of the soft packaging container 150.

The control section 40 may take into account the weight of the soft packaging container 150 itself in the determination of the closure timing or does not need to take the weight into account. For example, the control section 40 closes the soft packaging container 150 when the sensed weight becomes lower than a predetermined value without taking into account the weight of the soft packaging container 150 itself. In addition, the control section 40 may acquire information from a two-dimensional code of the soft packaging container 150 and detect the remaining amount of the contents 155 by taking into account the weight of the soft packaging container 150 itself.

Figure 4A:
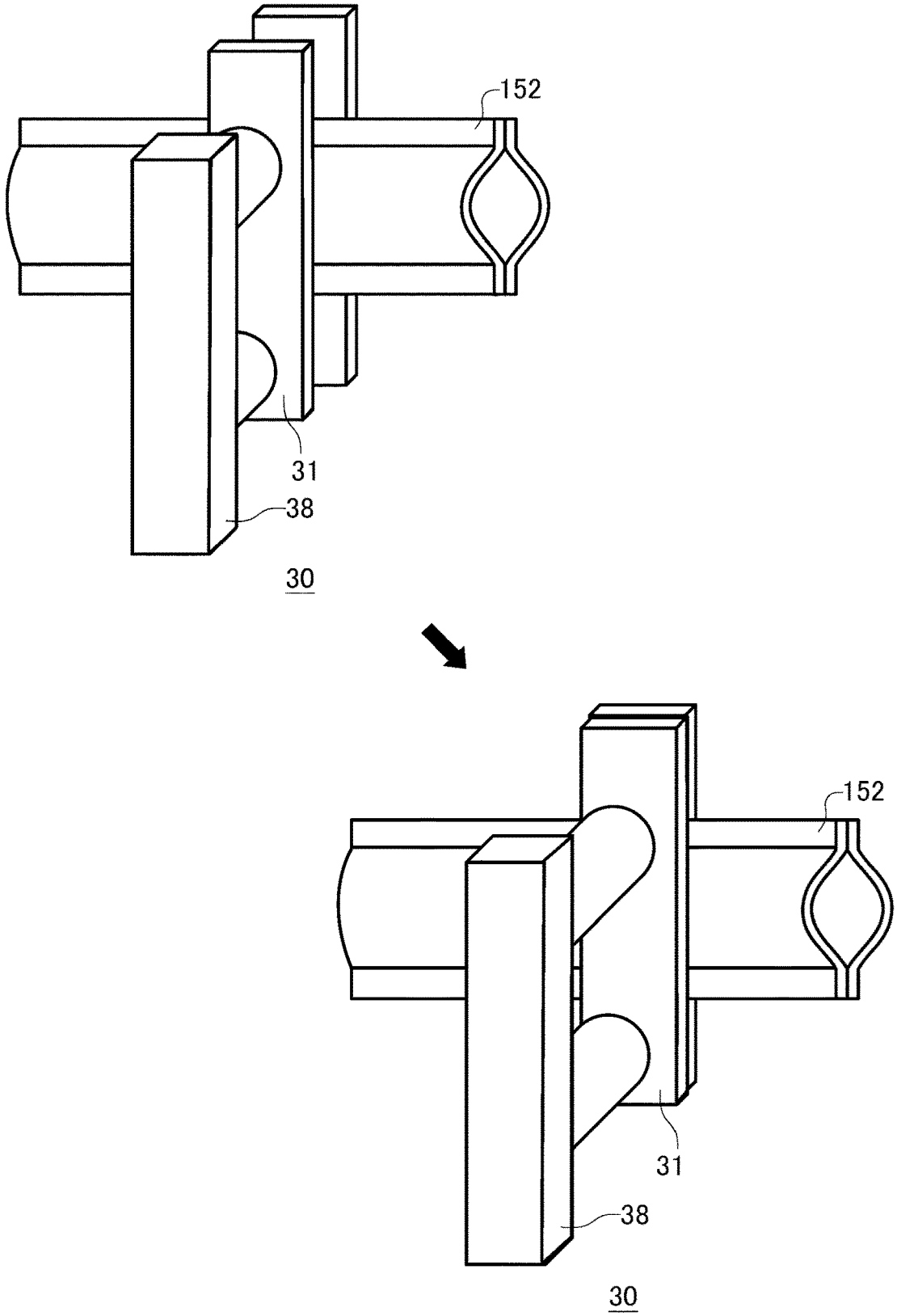
FIG. 4A illustrates an example of a configuration of a closure section 30.

FIG. 4A illustrates an example of a configuration of the closure section 30. The closure section 30 of the present example has a thermal welding mechanism 31 and a drive section 38.

The thermal welding mechanism 31 is configured to close the soft packaging container 150 by thermal welding. For example, the thermal welding mechanism 31 is a heat sealer for closing the soft packaging container 150. The thermal welding mechanism 31 of the present example is arranged so as to face a closure position of the extension region 152. In order to prevent thermal welding failure, the thermal welding mechanism 31 may be arranged in a region where it is difficult for the contents 155 to stay. The closure section 30 of the present example can prevent leakage of the contents 155 by closing an opening of the extension region 152 by the thermal welding mechanism 31.

The drive section 38 is configured to drive the thermal welding mechanism 31 so as to nip the extension region 152. The drive section 38 of the present example nips the extension region 152 by moving a position of the thermal welding mechanism 31 by an air cylinder. The drive section 38 drives the thermal welding mechanism 31 at timing at which the control section 40 instructs closure of the soft packaging container 150.

The closure section 30 of the present example closes the extension region 152 in a state where the soft packaging container 150 is removed from the dispense section 20, but may close the extension region 152 in a state where the dispense section 20 is inserted into the extension region 152. In this case, the thermal welding mechanism 31 is arranged so as to avoid the dispense section 20, and performs thermal welding of the extension region 152.

Figure 4B:
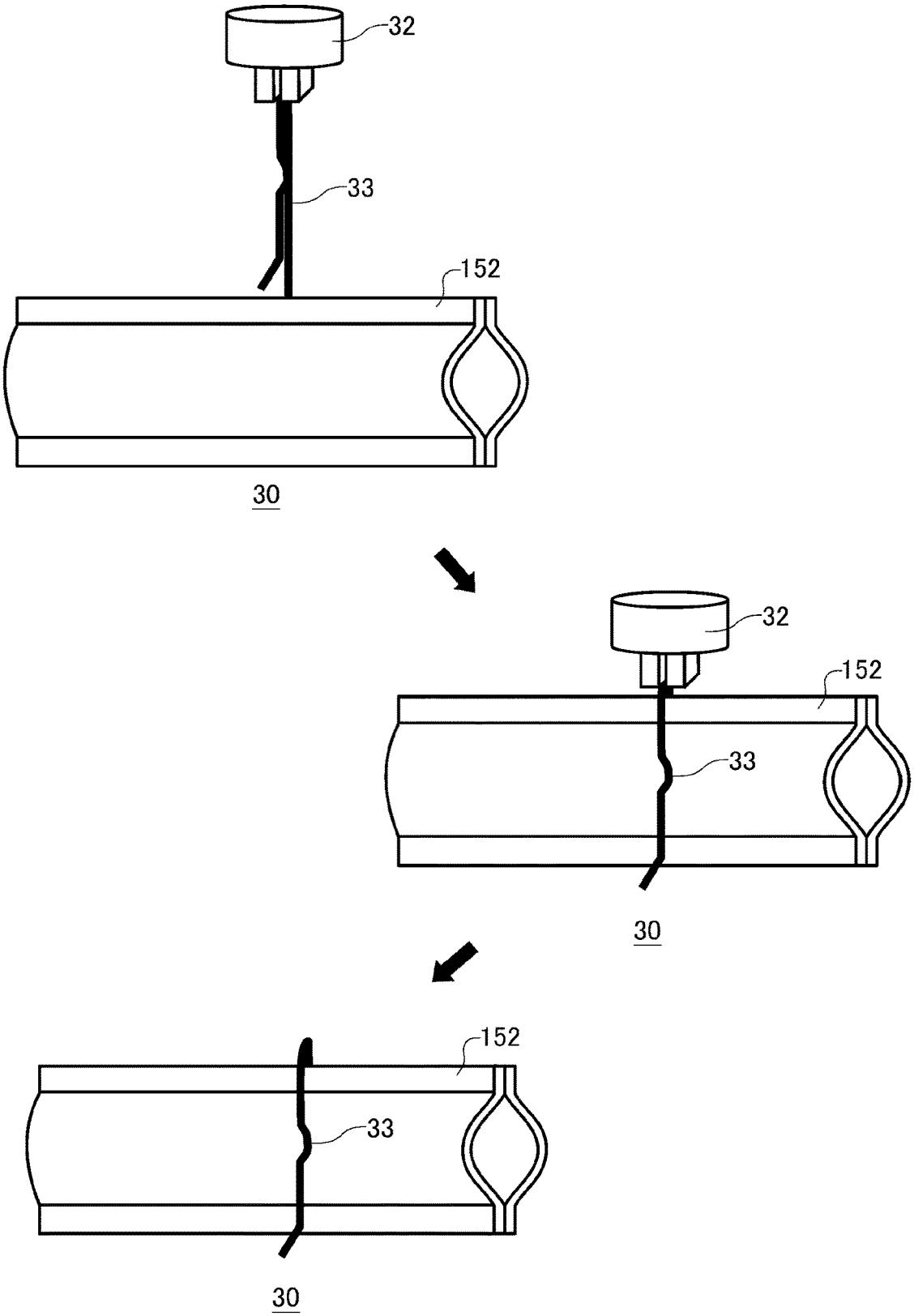
FIG. 4B illustrates an example of the configuration of the closure section 30.

FIG. 4B illustrates an example of the configuration of the closure section 30. The closure section 30 of the present example has a closure member applying mechanism 32 and a closure member 33.

The closure member applying mechanism 32 applies the closure member 33 to the soft packaging container 150 to be closed. For example, the closure member applying mechanism 32 nips the extension region 152 by the closure member 33 to close the soft packaging container 150. For example, the closure member applying mechanism 32 is a robot hand that can move in a state where the closure member 33 is grabbed at will or release the closure member 33.

The closure member 33 is applied to the soft packaging container 150 to close the extension region 152. The closure member 33 of the present example is a clip but is not limited to this. The closure member 33 may be a rubber band, an adhesive tape, or the like for closing the extension region 152.

The closure member applying mechanism 32 of the present example nips the extension region 152 with the clip by vertically moving the closure member 33. After the closure member 33 is attached to the extension region 152, the closure member applying mechanism 32 releases the closure member 33. Therefore, the soft packaging container 150 can be removed to the outside of the closure device 100 in a state where the closure member 33 is mounted.

Figure 4C:
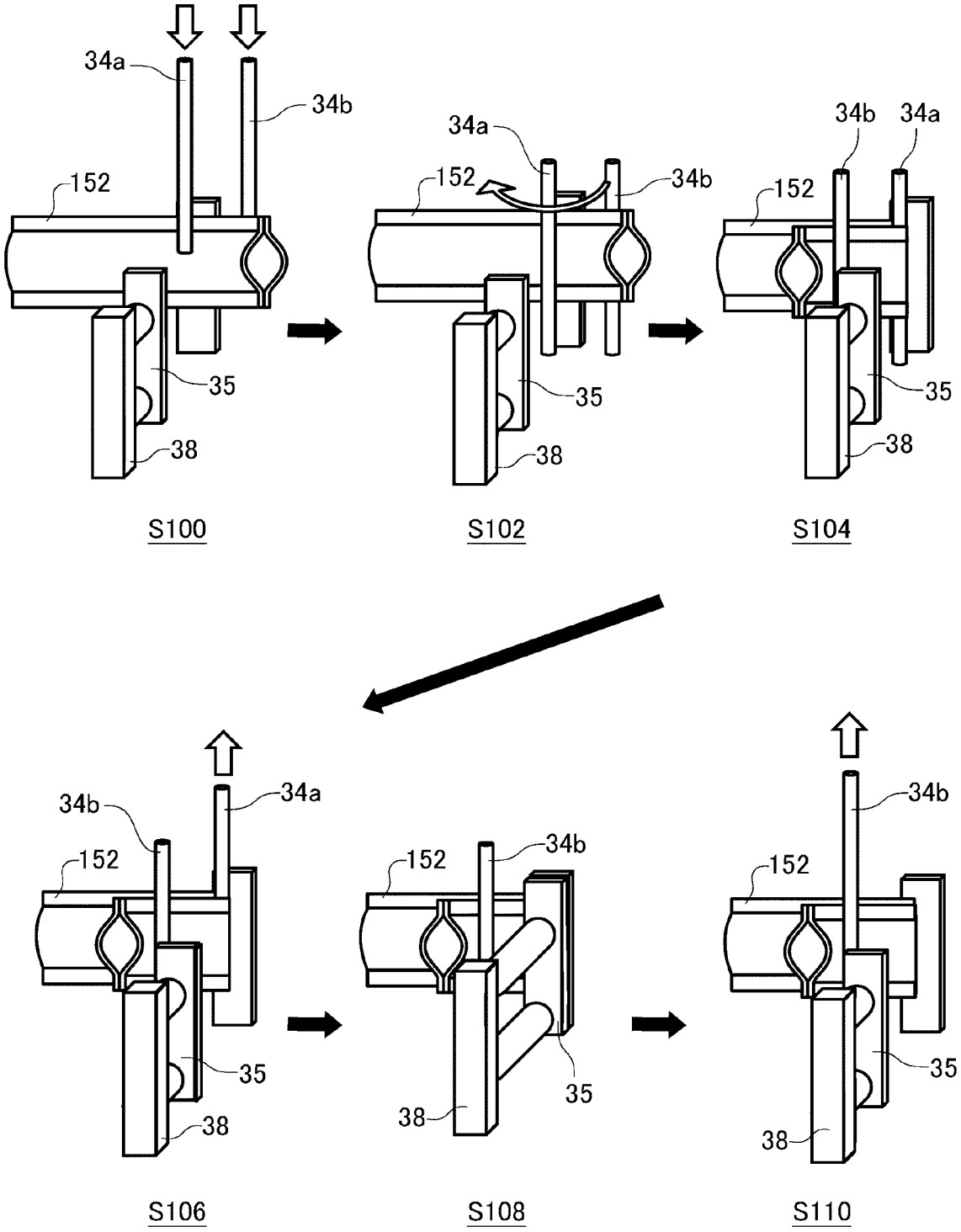
FIG. 4C illustrates an example of the configuration of the closure section 30.

FIG. 4C illustrates an example of the configuration of the closure section 30. The closure section 30 of the present example has a folding mechanism 34.

The folding mechanism 34 is configured to fold the soft packaging container 150. The closure section 30 of the present example has two bar-shaped folding mechanism 34*a* and folding mechanism 34*b*. For example, the folding mechanism 34*a* and the folding mechanism 34*b* are robot fingers that can be manipulated at will.

A restraint section applying mechanism 35 is configured to apply a restraint section 36 which will be described below to the extension region 152 so as to prevent the folded extension region 152 from returning to its original state. For example, the restraint section applying mechanism 35 closes the extension region 152 by thermal welding.

In step S100, the folding mechanism 34*a* and the folding mechanism 34*b* nip the extension region 152. Before step S100, the dispense section 20 may be extracted from the soft packaging container 150, or after step S100, the dispense section 20 may be extracted from the soft packaging container 150.

In step S102, the extension region 152 is turned down by the folding mechanism 34*b* with the folding mechanism 34*a* set as a supporting point. In step S104, the extension region 152 is maintained in a folded state by the folding mechanism 34*b*.

In step S106, while the folding of the extension region 152 is maintained by the folding mechanism 34*b*, the folding mechanism 34*a* set as the supporting point is extracted. In step S108, the restraint section applying mechanism 35 is pressed at a closure position of the extension region 152. In step S110, the folding mechanism 34*b* is extracted. In this manner, the folding mechanism 34 realizes the folding and the thermal welding of the extension region 152.

Figure 5A:
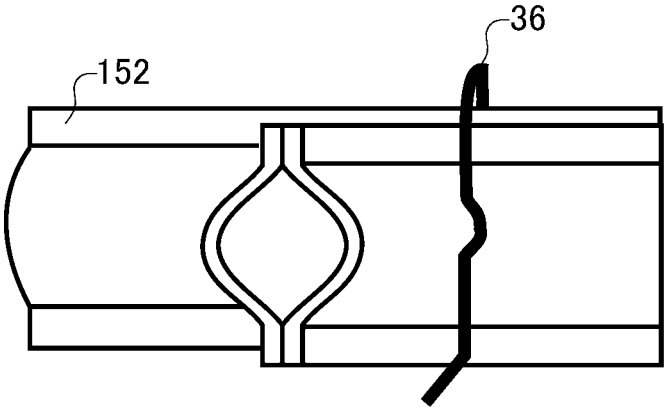
FIG. 5A illustrates an example of a restraint section 36.

FIG. 5A illustrates an example of the restraint section 36. The restraint section 36 is applied to the folded extension region 152 by the restraint section applying mechanism 35.

The restraint section 36 is configured to restraint a folded section applied by the folding mechanism 34. Since the restraint section 36 of the present example is a clip, the closed soft packaging container 150 is easily unsealed.

Figure 5B:
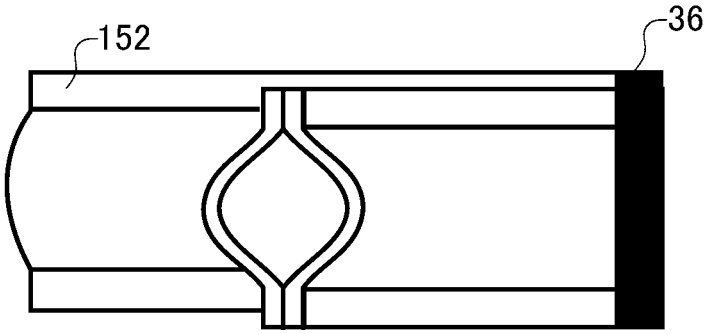
FIG. 5B illustrates an example of the restraint section 36.

FIG. 5B illustrates an example of the restraint section 36. The restraint section 36 is a region where the extension region 152 has been subjected to thermal welding by the restraint section applying mechanism 35. The extension region 152 of the present example is closed by folding, and maintains the folded state by thermal welding. That is, the restraint section 36 of the present example is obtained by thermal welding of mutual external surfaces of the extension region 152, and it does not need to perform thermal welding of an inner side of the extension region 152 through which the contents 155 passes. Therefore, thermal welding failure hardly occurs due to residue of the contents 155.

Figure 5C:
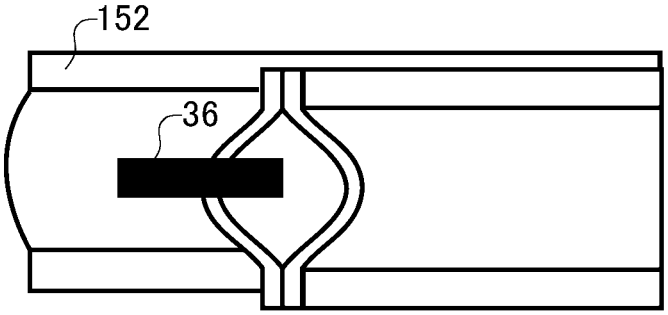
FIG. 5C illustrates an example of the restraint section 36.

FIG. 5C illustrates an example of the restraint section 36. The restraint section 36 is an adhesive tape. Since the restraint section 36 of the present example is an adhesive tape, the closed soft packaging container 150 is easily unsealed. In addition, the restraint section 36 of the present example can be disposed together with the spent soft packaging container 150. Note that the restraint sections 36 illustrated in FIG. 5A to FIG. 5C may be mutually combined.

Figure 6:
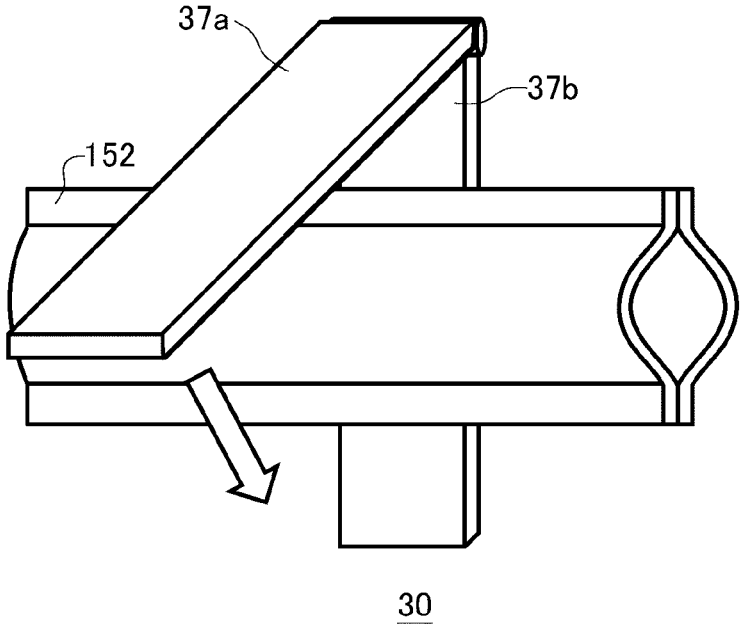
FIG. 6 illustrates an example of the closure section 30 having a pinching mechanism 37.
Figure 6:
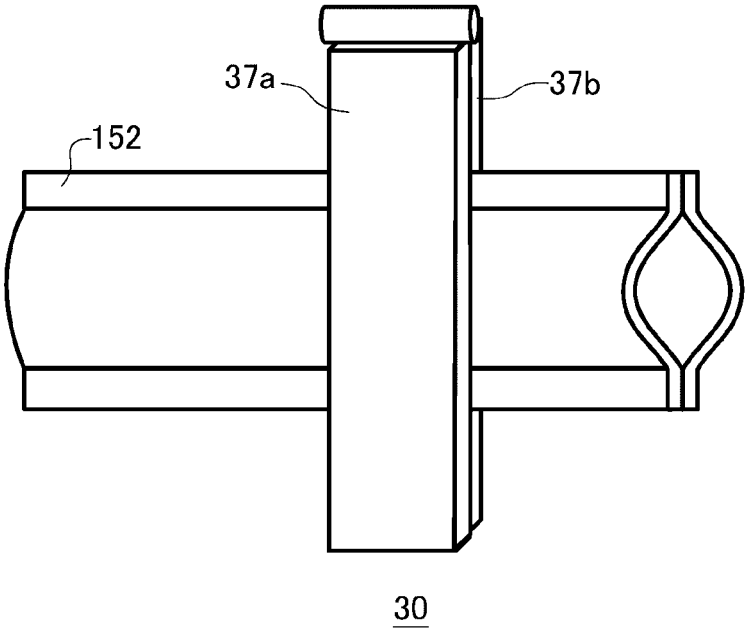

FIG. 6 illustrates an example of the closure section 30 having a pinching mechanism 37. The pinching mechanism 37 is configured to pinch the soft packaging container 150 to be closed. The closure section 30 of the present example has a pair of a pinching mechanism 37*a* and a pinching mechanism 37*b*. The pinching mechanism 37*a* has a mechanism configured to rotate about the pinching mechanism 37*b*. The closure section 30 pinches the extension region 152 by arranging the extension region 152 between the pinching mechanism 37*a* and the pinching mechanism 37*b* and rotating the pinching mechanism 37*a* for closing.

The pinching mechanism 37 may be fixed to any configuration of the closure device 100. For this reason, a configuration may be adopted where the soft packaging container 150 cannot be removed from the closure device 100 in a closed state by the pinching mechanism 37. When the soft packaging container 150 is removed from the closure device 100, the soft packaging container 150 may be separated from the pinching mechanism 37. Therefore, in the closure device 100 of the present example, the pinching mechanism 37 can be repeatedly used even when the soft packaging container 150 is replaced.

Figure 7A:
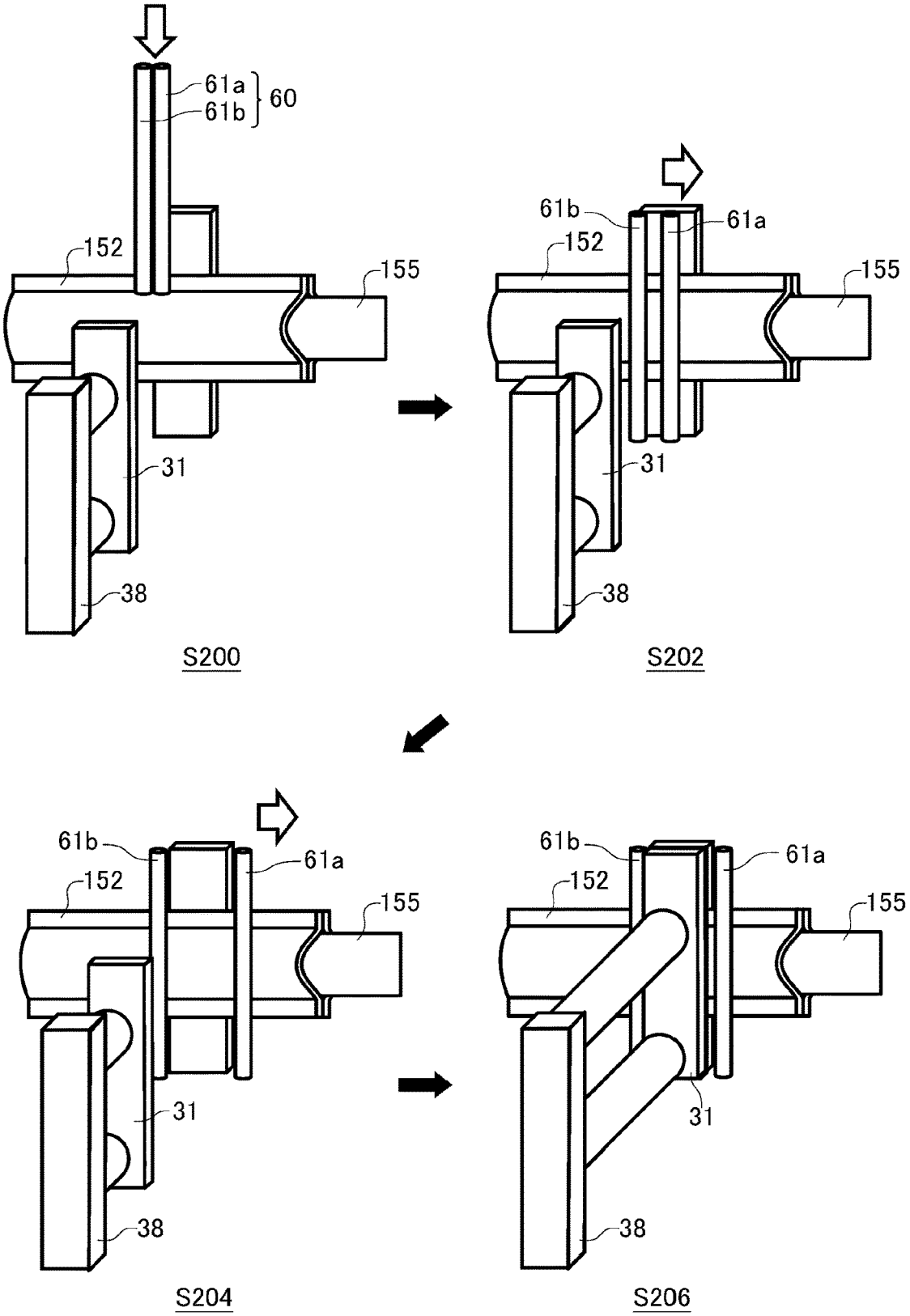
FIG. 7A illustrates an example of a configuration of a failure avoiding section 60.

FIG. 7A illustrates an example of a configuration of a failure avoiding section 60. The failure avoiding section 60 of the present example has a squeezing mechanism 61. The failure avoiding section 60 of the present example has two squeezing mechanism 61*a* and squeezing mechanism 61*b*.

The failure avoiding section 60 is configured to prevent residue of the contents 155 by moving the contents 155 in the closure region of the soft packaging container 150. In this manner, the failure avoiding section 60 avoids the failure upon closure of the soft packaging container 150.

The squeezing mechanism 61 is used to squeeze the soft packaging container 150. The squeezing mechanism 61 is configured to move the contents 155 in the closure region by squeezing the contents 155 of the soft packaging container 150. For example, the squeezing mechanism 61 is robot fingers for squeezing.

In step S200, the squeezing mechanism 61*a* and the squeezing mechanism 61*b* are vertically moved to be arranged at positions corresponding to the closure region of the extension region 152. In step S202, in a state where the squeezing mechanism 61*b* is fixed, the squeezing mechanism 61*a* is slid to an opening side of the extension region 152. The squeezing mechanism 61*b* may be pressed against the extension region 152 to restrict movement of the contents 155 from the main region 151 side to the opening side.

In step S204, the contents 155 in the closure region is discharged by sliding of the squeezing mechanism 61*a*. In step S206, thermal welding is performed by pressing the thermal welding mechanism 31 against the extension region 152 between the squeezing mechanism 61*a* and the squeezing mechanism 61*b*. In the present example, since the contents 155 in the closure region is discharged, the failure upon closure by the contents 155 can be avoided.

Figure 7B:
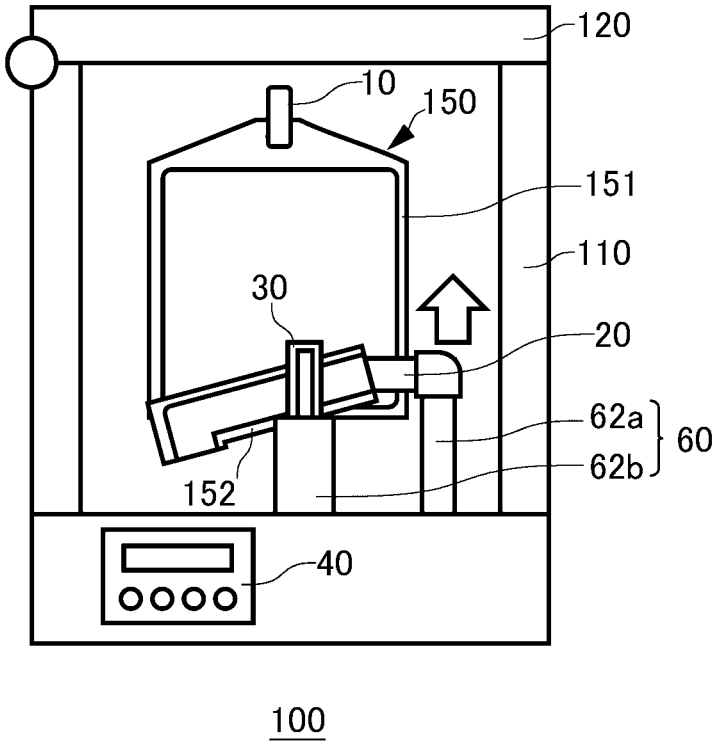
FIG. 7B illustrates an example of the configuration of the failure avoiding section 60.

FIG. 7B illustrates an example of the configuration of the failure avoiding section 60. The failure avoiding section 60 of the present example has an orientation change section 62.

The orientation change section 62 is configured to change an orientation of the soft packaging container 150. For example, the orientation change section 62 changes an orientation of the extension region 152. The orientation change section 62 moves the contents 155 from the closure region by the change in the orientation of the soft packaging container 150. The failure avoiding section 60 of the present example includes an orientation change section 62*a* and an orientation change section 62*b*.

The orientation change section 62*a* is connected to the dispense section 20 and changes a position of the dispense section 20. The orientation change section 62*a* of the present example is configured to change a position of the opening of the extension region 152 by changing a position of the dispense section 20. The orientation change section 62*a* may change the position of the dispense section 20 in not only the vertical direction but also a horizontal direction.

The orientation change section 62*b* is connected to the closure section 30 and changes a position of the closure section 30. The orientation change section 62*b* may change the position of the closure section 30 according to control of the orientation change section 62*a*. For example, the orientation change section 62*b* may change the position of the closure section 30 in not only the vertical direction but also the horizontal direction according to a position of the extension region 152.

The orientation change section 62*a* of the present example raises the position of the opening of the extension region 152 by extending upwards. In this manner, since the contents 155 in the closure region of the extension region 152 flows onto an opposite side of the opening of The extension region 152, the failure upon closure of the soft packaging container 150 can be avoided. Note that the orientation change section 62*b* of the present example may extend upwards or does not need to extend.

Figure 7C:
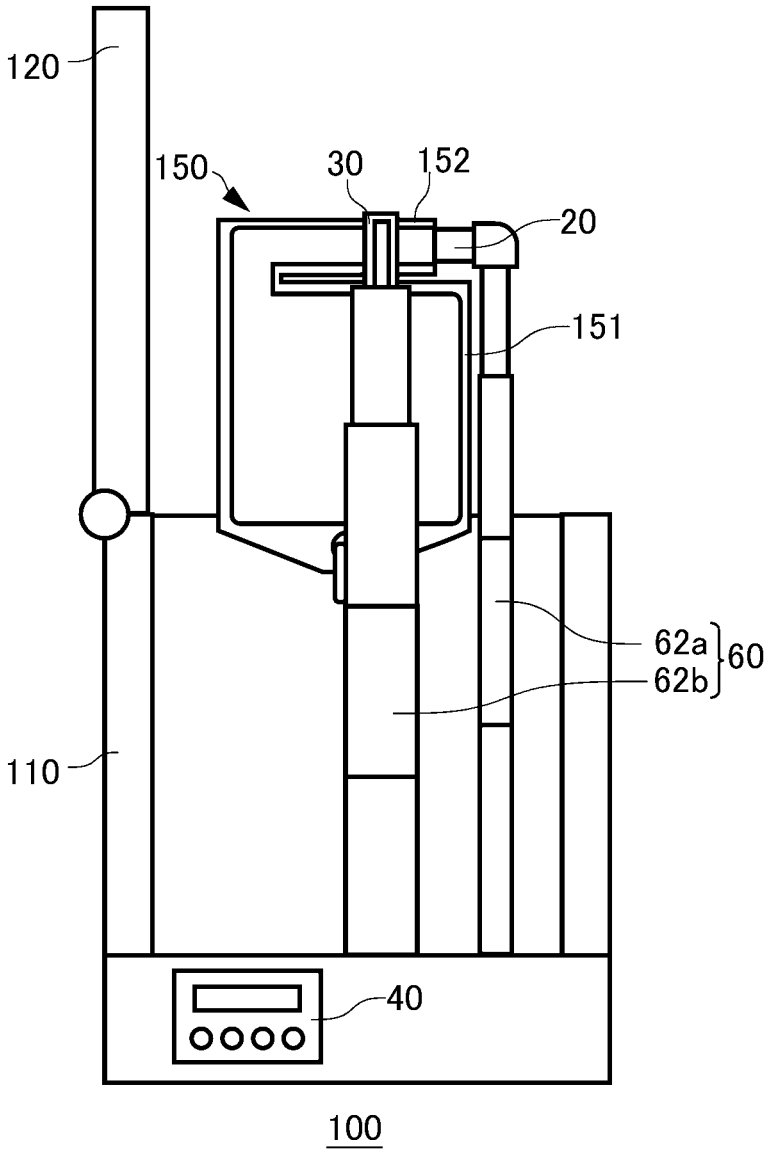
FIG. 7C illustrates an example of the configuration of the failure avoiding section 60.

FIG. 7C illustrates an example of the configuration of the failure avoiding section 60. Similarly as in FIG. 7B, the failure avoiding section 60 of the present example has the orientation change section 62. In the present example, a change degree of the orientation of the soft packaging container 150 is different from the embodiment of FIG. 7B.

The orientation change section 62*a* and the orientation change section 62*b* change the orientation of the soft packaging container 150 upside down by extending upwards. In this manner, since the contents 155 in the closure region of the extension region 152 flows to the main region 151, the failure upon closure of the soft packaging container 150 can be avoided.

The closure device 100 of the present example arranges the soft packaging container 150 outside the accommodation section 110 by extending the orientation change section 62.

For this reason, the soft packaging container 150 is closed, and the soft packaging container 150 can be immediately removed. Note that the closure device 100 may accommodate the soft packaging container 150 inside the accommodation section 110 even in a vertically inverted state.

Figure 8:
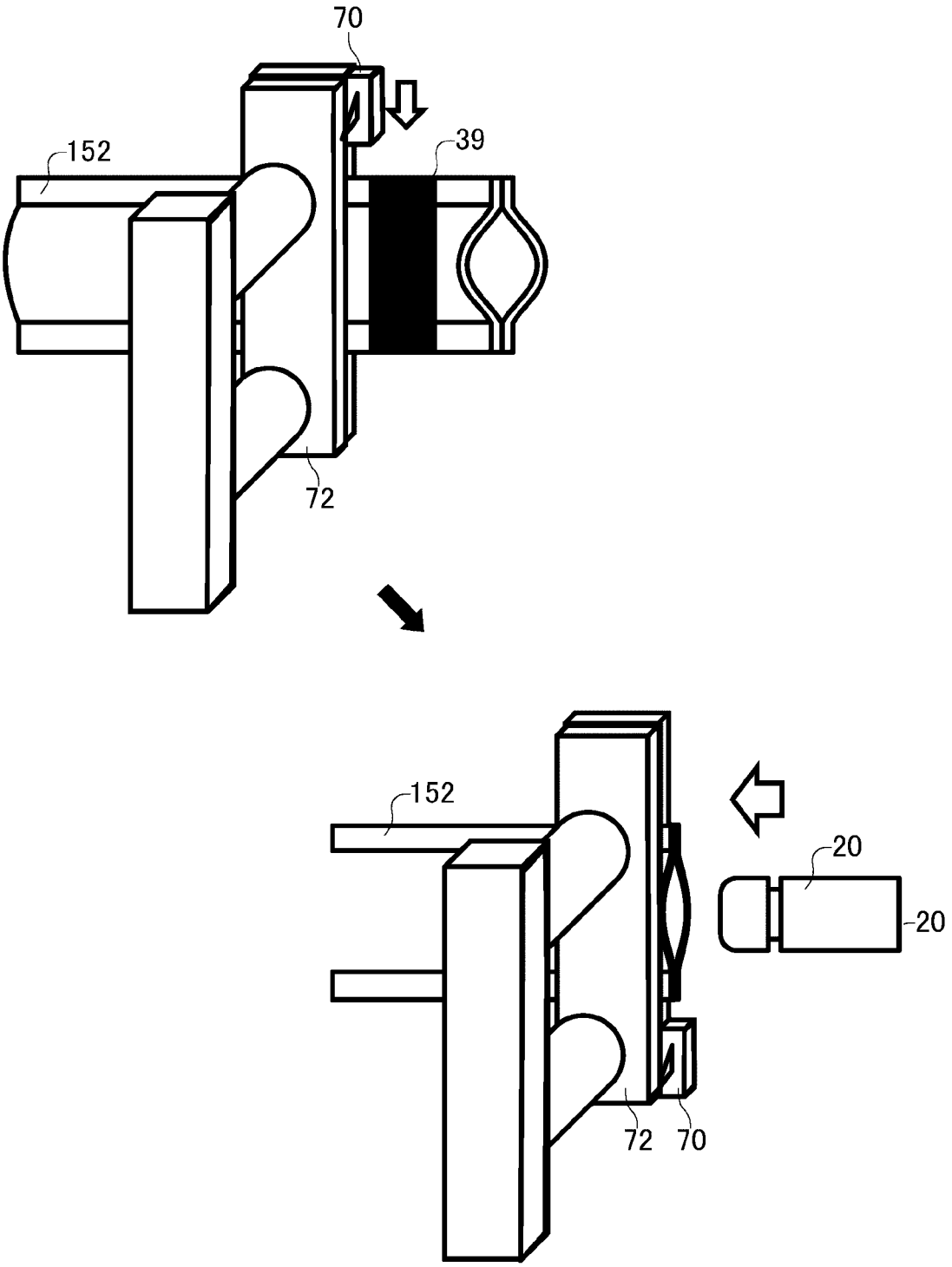
FIG. 8 illustrates an example of a cutting section 70.

FIG. 8 illustrates an example of a cutting section 70. The closure device 100 of the present example includes the cutting section 70 and a fixed section 72. The extension region 152 has a thermal welding section 39 having been subjected to thermal welding by the thermal welding mechanism 31.

The cutting section 70 is configured to unseal the soft packaging container 150 by cutting the closed soft packaging container 150. The cutting section 70 of the present example unseals the soft packaging container 150 by cutting the extension region 152. In this manner, after the soft packaging container 150 is accommodated in the closure device 100 while being still sealed, the closure device 100 can unseal the soft packaging container 150. The cutting section 70 may unseal the soft packaging container 150 in a state where the orientation of the soft packaging container 150 is fixed such that the contents 155 is not to be leaked.

The fixed section 72 nips and fixes the extension region 152 in order to cut the extension region 152. The fixed section 72 of the present example closes a path of the contents 155 in order to prevent the leakage of the contents 155 when unsealed. It it noted however that the fixed section 72 does not need to close the path of the contents 155 in such an orientation that the contents 155 is not to be leaked.

Note that the fixed section 72 may have a thermal welding function of the extension region 152. In this case, the closure device 100 can repeat closure and unsealing of the soft packaging container 150. Since the extension region 152 is shortened when the closure and the unsealing of the soft packaging container 150 are repeated, positions of the closure section 30 and the cutting section 70 may be adjusted according to a length of the extension region 152.

Figure 9A:
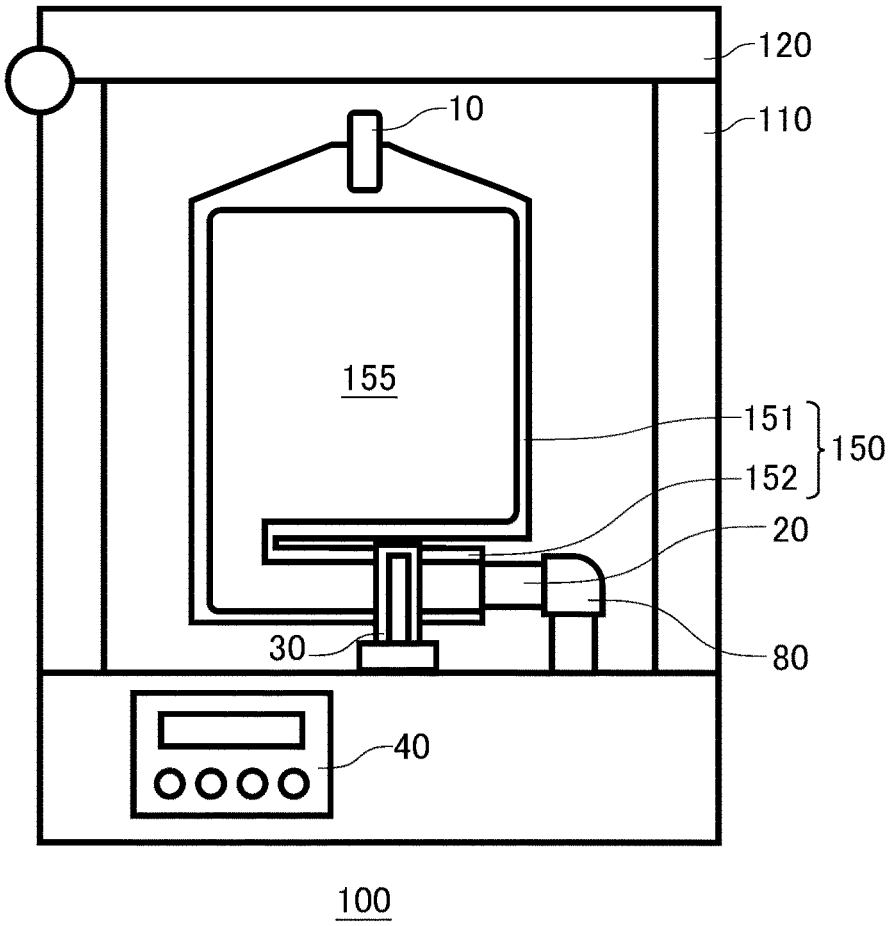
FIG. 9A illustrates an example of the closure device 100 including a closure detection section 80.

FIG. 9A illustrates an example of the closure device 100 including a closure detection section 80. The closure device 100 of the present example includes a flowmeter as the closure detection section 80 which is configured to measure a flow rate of the contents 155.

The closure detection section 80 is configured to detect closure of the soft packaging container 150 by measuring a flow rate of the contents 155. For example, the closure detection section 80 determines that the soft packaging container 150 is closed when the flow rate of the contents 155 is lower than a predetermined flow rate. The closure detection section 80 of the present example is provided in the dispense section 20.

According to another embodiment, the closure detection section 80 may calculate the flow rate of the contents 155 from a change in the weight of the soft packaging container 150 instead of measuring the flow rate of the contents 155. In this case, the closure detection section 80 determines that the soft packaging container 150 is closed when a change amount of the weight of the soft packaging container 150 is lower than a predetermined value.

Figure 9B:
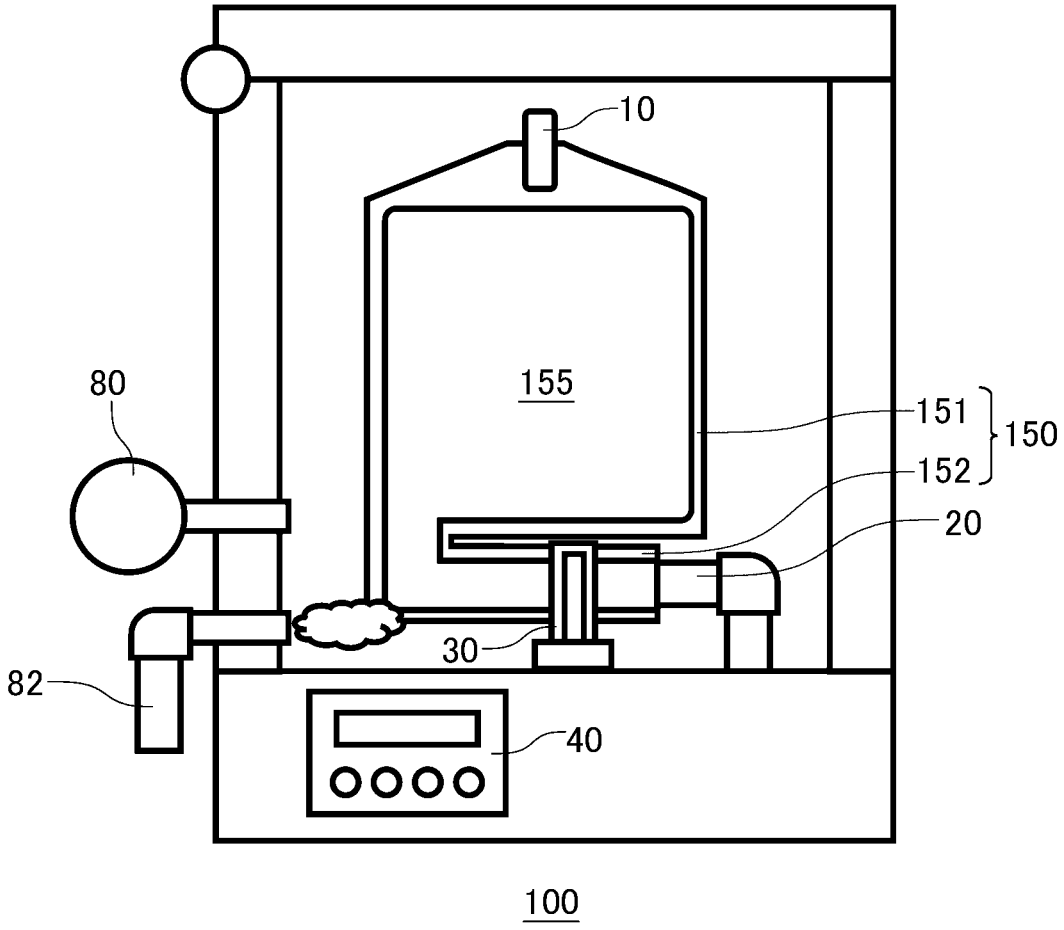
FIG. 9B illustrates an example of the closure device 100 including the closure detection section 80.

FIG. 9B illustrates an example of the closure device 100 including the closure detection section 80. The closure device 100 of the present example includes a manometer as the closure detection section 80 which is configured to measure a pressure inside the accommodation section 110.

The closure detection section 80 is configured to detect closure of the soft packaging container 150 by measuring the pressure inside the accommodation section 110. For example, in a case where the closure of the soft packaging container 150 is satisfactory, when a pressure source 82 is actuated, a pressure is increased. On the other hand, in the case of closure failure, since the soft packaging container 150 collapses, a pressure increase speed is decreased.

Figure 10:
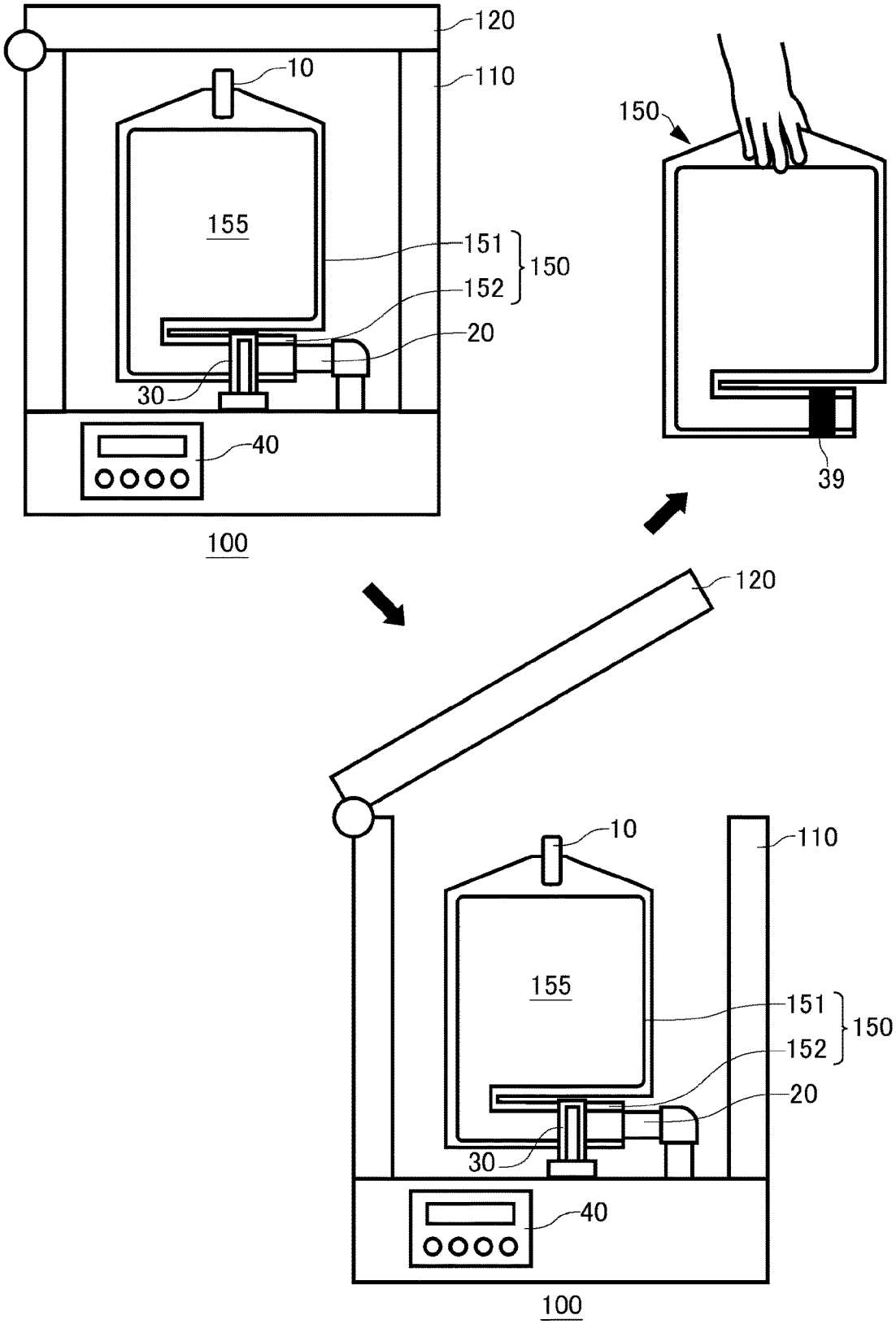
FIG. 10 illustrates an example of the configuration of the closure device 100 including a locking mechanism.

FIG. 10 illustrates an example of the configuration of the closure device 100 including a locking mechanism. The closure device 100 of the present example is configured to prevent unintended opening and closing of the accommodation section 110 by locking the lid section 120. For example, the closure device 100 opens the accommodation section 110 after the soft packaging container 150 is closed. In this manner, the closure device 100 prevents contamination by the contents 155 upon opening and closing of the accommodation section 110 due to carelessness of a user or the like. In addition, the closure device 100 may protect the user from high heat by locking the lid section 120 upon thermal welding.

Figure 11:
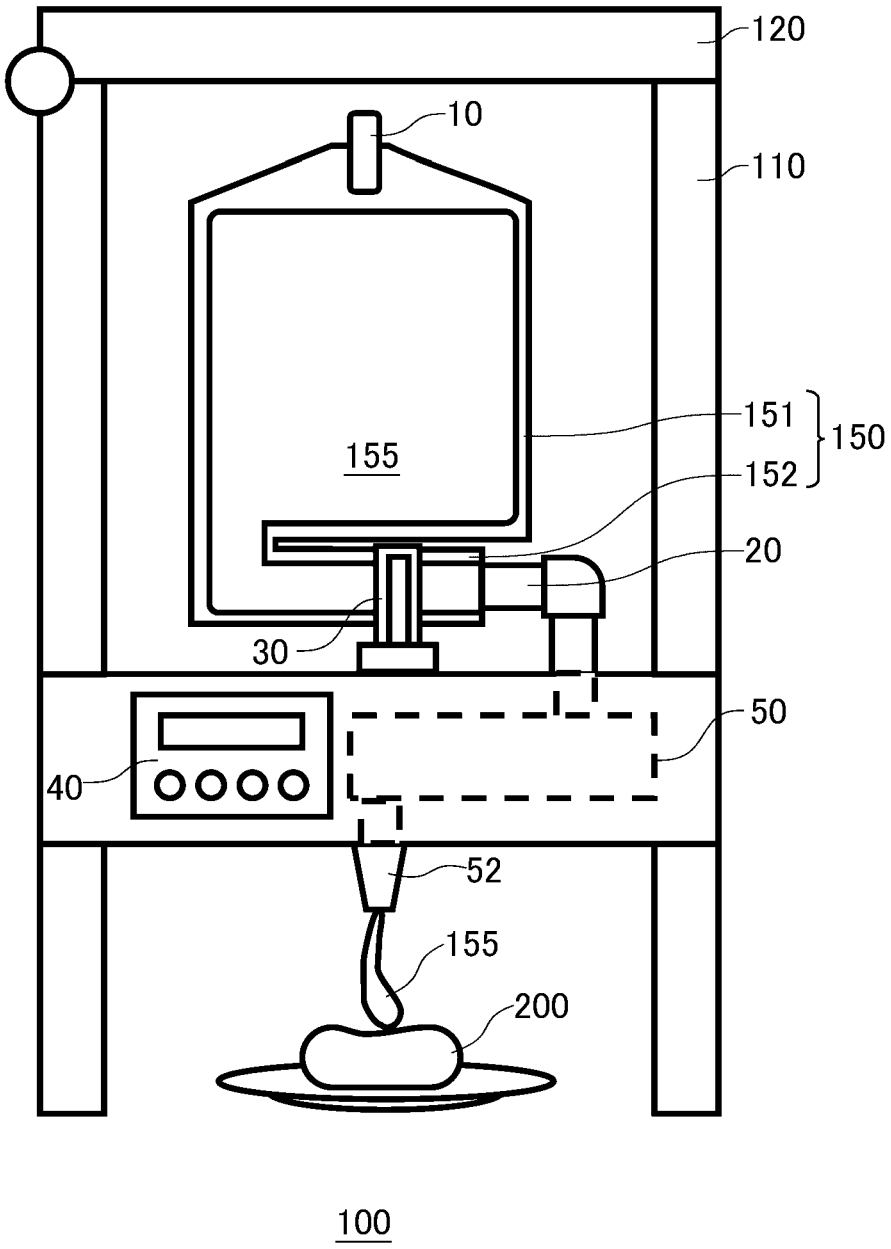
FIG. 11 illustrates an example of the configuration of the closure device 100.

FIG. 11 illustrates an example of the configuration of the closure device 100. The closure device 100 of the present example includes an ejection device 50.

The ejection device 50 is configured to eject the contents 155 of the soft packaging container 150. The ejection device 50 of the present example is coupled to the dispense section 20 and ejects the contents 155 dispensed by the dispense section 20 from the nozzle 52. For example, the ejection device 50 ejects the contents 155 using a pump. The ejection device 50 may decide an amount of the contents 155 to be ejected each time, a flow rate of the contents 155, and the like.

Figure 12:
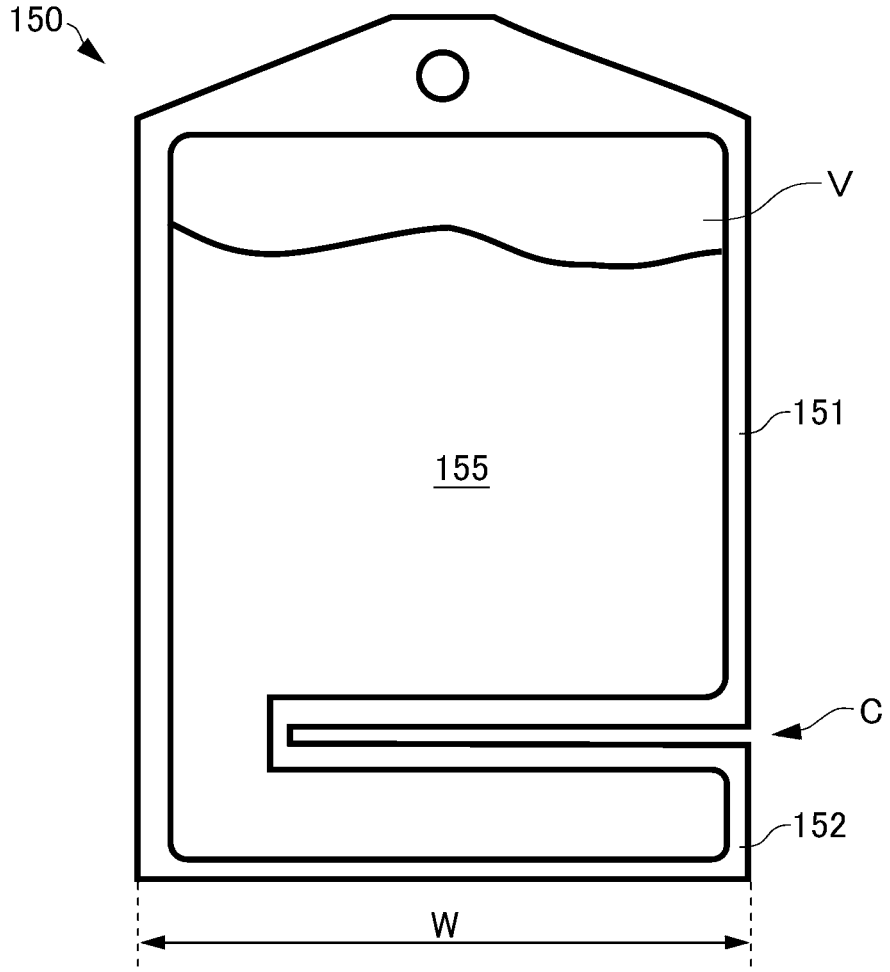
FIG. 12 illustrates an example of a shape of a soft packaging container 150.

FIG. 12 illustrates an example of a shape of the soft packaging container 150. The soft packaging container 150 of the present example has the main region 151 and the extension region 152.

The main region 151 and the extension region 152 are separated from each other by a slit C. A slit stop section may be provided at an edge of the slit C so as not to generate a fissure when the slit C is formed. For example, the generation of the fissure can be prevented by providing an opening at the edge of the slit C in advance.

The extension region 152 is provided along an edge of the soft packaging container 150. In this manner, the extension region 152 can freely adjust the position according to the position of the dispense section 20. In addition, folding of the extension region 152 is facilitated. Then, the position of the opening of the extension region 152 can be easily freely adjusted according to the orientation of the soft packaging container 150.

The main region 151 and the extension region 152 form a C-shaped structure. Since the extension region 152 is provided, the soft packaging container 150 of the present example more easily avoids thermal welding failure by the thermal welding mechanism 31 as compared with a case where the extension region 152 is not provided.

A spatial region V is a region that is not occupied by the contents 155 inside the soft packaging container 150. A volume of the spatial region V is equal to or more than a volume of the extension region 152. In other words, the volume of the contents 155 in a still sealed state may be smaller than a spatial volume of the main region 151. In this manner, the dispense section 20 is easily mounted since the extension region 152 can be emptied by accommodating the contents 155 in only the main region 151. In addition, when the soft packaging container 150 is to be closed immediately after being unsealed, since the extension region 152 is not yet filled, closure failure hardly occurs. Furthermore, the soft packaging container 150 has a margin of the spatial region V in a still sealed state, handling such as folding is facilitated.

The extension region 152 has a length that is 50% or more of a width W of the soft packaging container 150. The extension region 152 may have a length that is 75% or more, or may have a length that is 90% or more, of the width W of the soft packaging container 150. In the present example, the length of the extension region 152 is the same as the width W of the soft packaging container 150.

The length of the extension region 152 may be longer, or may be shorter, than the width W of the soft packaging container 150. The length of the extension region 152 may be decided by taking into account an insertion length of the dispense section 20 into the extension region 152, a length required for closure by the closure section 30, a flow path length from the main region 151 to the extension region 152, or the like. For example, the length of the extension region 152 is at least 40 mm or more. In addition, the length of the extension region 152 is 40 mm or more and may be equal to or less than the width W of the soft packaging container 150.

While the embodiments of the present invention have been described, the technical scope of the present invention is not limited to the above described embodiments. It is apparent to persons skilled in the art that various alterations and improvements can be added to the above-described embodiments. It is also apparent from the scope of the claims that the embodiments added with such alterations or improvements can be included in the technical scope of the present invention.

The operations, procedures, steps, and stages of each process performed by an apparatus, system, program, and method shown in the claims, embodiments, or diagrams can be performed in any order as long as the order is not indicated by "prior to," "before," or the like and as long as the output from a previous process is not used in a later process. Even if the process flow is described using phrases such as "first" or "next" in the claims, embodiments, or diagrams, it does not necessarily mean that the process must be performed in this order.

EXPLANATION OF REFERENCES

10: holding section, 20: dispense section, 30: closure section, 31: thermal welding mechanism, 32: closure member applying mechanism, 33: closure member, 34: folding mechanism, 35: restraint section applying mechanism, 36: restraint section, 37: pinching mechanism, 38: drive section, 39: thermal welding section, 40: control section, 41: acquisition section, 42: time information output section, 43: information output section, 44: sensing section, 45: closure instruction section, 50: ejection device, 52: nozzle, 60: failure avoiding section, 61: squeezing mechanism, 62: orientation change section, 70: cutting section, 72: fixed section, 80: closure detection section, 82: pressure source, 100: closure device, 110: accommodation section, 120: lid section, 150: soft packaging container, 151: main region, 152: extension region, 155: contents, 200: object

What is claimed is:

1. A closure device for closing a soft packaging container, the closure device comprising:

a holding section configured to hold a soft packaging container;

a dispense section configured to dispense contents of the soft packaging container;

a closure section configured to close the soft packaging container; and a control section configured to control timing for closing the soft packaging container by the closure section, wherein the control section includes an acquisition section configured to acquire time information related to timing for closing the soft packaging container, and the control section is configured to close the soft packaging container according to the time information acquired by the acquisition section.

2. The closure device according to claim 1, wherein the control section includes a sensing section configured to sense a content amount of the soft packaging container.

3. The closure device according to claim 1, wherein the closure section is configured to close the soft packaging container when a content amount of the soft packaging container becomes lower than a predetermined amount.

4. The closure device according to claim 1, wherein the closure section has a closure member applying mechanism configured to apply a closure member to the soft packaging container to be closed.

5. The closure device according to claim 1, wherein the closure section has a folding mechanism configured to fold the soft packaging container.

6. The closure device according to claim 5, wherein the closure section has a restraint section applying mechanism configured to restraint a folded section applied by the folding mechanism.

7. The closure device according to claim 1, comprising:

a failure avoiding section configured to avoid failure upon closure by moving contents in a closure region of the soft packaging container.

8. The closure device according to claim 7, wherein the failure avoiding section has a squeezing mechanism configured to squeeze the soft packaging container, and the squeezing mechanism is configured to squeeze contents of the soft packaging container to move the contents in the closure region.

9. The closure device according to claim 7, wherein the failure avoiding section has an orientation change section configured to change an orientation of the soft packaging container, and the orientation change section is configured to move the contents from the closure region by a change in an orientation of the soft packaging container.

10. The closure device according to claim 1, comprising:

a cutting section configured to cut the closed soft packaging container to be unsealed.

11. The closure device according to claim 1, comprising:

an accommodation section configured to accommodate the soft packaging container, wherein the accommodation section is opened after closure of the soft packaging container.

12. The closure device according to claim 1, wherein the dispense section includes an ejection device configured to eject the contents of the soft packaging container.

13. The closure device according to claim 1, wherein the control section includes a sensing section configured to sense a content amount of the soft packaging container.

14. A closure device for closing a soft packaging container, the closure device comprising:

a holding section configured to hold a soft packaging container;

a dispense section configured to dispense contents of the soft packaging container;

a closure section configured to close the soft packaging container; and a control section configured to control timing for closing the soft packaging container by the closure section, wherein the closure section has a thermal welding mechanism configured to close the soft packaging container by thermal welding.

15. A closure device for closing a soft packaging container, the closure device comprising:

a holding section configured to hold a soft packaging container;

a dispense section configured to dispense contents of the soft packaging container;

a closure section configured to close the soft packaging container; and a control section configured to control timing for closing the soft packaging container by the closure section, wherein the closure section has a pinching mechanism configured to pinch the soft packaging container to be closed.

16. A closure device for closing a soft packaging container, the closure device comprising:

a holding section configured to hold a soft packaging container;

a dispense section configured to dispense contents of the soft packaging container;

a closure section configured to close the soft packaging container; and a control section configured to control timing for closing the soft packaging container by the closure section; and a closure detection section configured to detect closure of the soft packaging container.

* * * * *